US005838192A

United States Patent [19]

Bowers et al.

[11] Patent Number: 5,838,192

[45] **Date of Patent: *Nov. 17, 1998**

[54] JUNCTION FIELD EFFECT VOLTAGE REFERENCE

[75] Inventors: Derek F. Bowers, Sunnyvale; Larry C. Tippie, Santa Clara, both of Calif.

[73] Assignee: Analog Devices, Inc., Norwood, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 587,548

[22] Filed: Jan. 17, 1996

[51] Int. Cl.[6] ..... G05F 1/10

[52] U.S. Cl. ..... 327/541; 327/540; 327/543; 327/546; 323/316

[58] Field of Search ..... 327/538, 540, 327/541, 543, 545, 546, 539; 323/316

[56] References Cited

U.S. PATENT DOCUMENTS

| | | | |
|---|---|---|---|
| 4,068,134 | 1/1978 | Tobey, Jr. et al. | 327/541 |
| 4,267,501 | 5/1981 | Smith | 323/313 |
| 4,357,571 | 11/1982 | Roessler | 323/281 |
| 4,427,903 | 1/1984 | Sugimoto | 327/65 |
| 4,654,578 | 3/1987 | Salerno et al. | 323/313 |
| 4,952,821 | 8/1990 | Kokubun | 327/74 |
| 5,001,484 | 3/1991 | Weiss | 341/153 |
| 5,311,115 | 5/1994 | Archer | 323/315 |
| 5,424,663 | 6/1995 | Wong | 327/65 |
| 5,596,265 | 1/1997 | Wrathal et al. | 327/539 |

OTHER PUBLICATIONS

Fink et al., Ed., *Electronics Engineers' Handbook,* 3d ed. McGraw Hill Book Co., 1989, pp. 8.48–8.50.

Edward S. Yang, *Fundamentals of Semiconductor Devices,* McGraw Hill Book Company, New York, 1987, pp. 182–195.

*Primary Examiner*—Terry D. Cunningham

*Attorney, Agent, or Firm*—Koppel & Jacobs

[57] ABSTRACT

A JFET pair having unequal pinchoff voltages is operated in saturation with equal source-drain current to channel width-to-length ratios to provide a reference voltage output. Positive or negative voltage references can be implemented using either n-channel or p-channel JFETs. The pinchoff voltage difference results from the channel for one JFET having a heavier doping level than that of the other JFET.

10 Claims, 4 Drawing Sheets

JUNCTION FIELD EFFECT VOLTAGE REFERENCE

BACKGROUND OF THE INVENTION

1. Field of the Invention

This invention relates to voltage reference circuits and, more particularly, to low noise, linear temperature coefficient voltage reference circuits.

2. Description of the Related Art

Voltage reference circuits have been developed to provide precise voltage outputs for use in a variety of analog circuits such as operational amplifiers (op amps), digital-to-analog converters (DACs) and analog to digital converters (ADCs). Commonly used references include "Zener" and "bandgap", or ΔVBE, designs. Although such references are suitable for many applications, they are not without their problems. For example, their output voltages vary widely and nonlinearly with temperature, they are not always available in a desired voltage range, some exhibit a "hysteresis" effect, and their noise levels may preclude their use within systems which require a high degree of accuracy, especially low-power systems. Improved noise levels for both Zener and bandgap references may require operation at higher bias currents.

As an example, to attain sixteen bit accuracy over an operating temperature range of 100° C. (limiting error to ½ least significant bit), the temperature coefficient of an ADC's voltage reference cannot exceed 0.08 ppm/°C. and its noise density (for a 16 bit ADC with 10V full scale range), must be limited to 40 nV/√Hz. Operating at a bias current of 100 μA a Zener reference may have a noise density of 100 nV/√Hz and a bandgap reference 300 nV/√Hz. Improving this noise performance would require a greater operating current.

FIG. 1 illustrates a basic Zener voltage reference circuit. A voltage $+V_s$ is supplied to a resistor $R_s$ that is connected in series with a reverse-biased Zener diode D1, the anode of which is connected to the anode of a forward biased diode D2, whose cathode is connected to ground. The output reference voltage $V_{REF}$ appearing at terminal 9, the junction of the resistor RS and the cathode of D1, is the sum of the forward voltage drop of diode D2 and the avalanche voltage drop of diode D1. The attractive feature of this circuit is that, although the forward voltage drop of diode D2 exhibits a negative temperature coefficient, this offsets, to some degree, the positive temperature coefficient of the avalanche voltage drop of diode D1. However, since the initial temperature dependency of the diode D1 is relatively large, i.e. approximately 300 ppm/°C., establishing an offsetting voltage from the diode D2 which compensates for the variation in output voltage from diode D1 over a wide operating range is somewhat difficult.

Additionally, because the avalanche breakdown voltage of diode D1 is typically in the 5 to 8V range, the reference voltage produced by such a circuit is in the 6 to 9V range. Since the reference must be driven from a voltage source higher than 6V, Zener references are not suitable for operation in systems which employ 5V or the increasingly popular lower supplies. In addition, voltage references based upon temperature compensated avalanche diodes tend to be noisy, due to noise generated by the diode's breakdown mechanism.

Band-gap references provide a temperature-compensated reference which could operate from a lower (e.g. 5V or below) supply voltage. Band-gap references employ bipolar transistors having emitters of different sizes. Supplying the transistors with equal currents develops a difference in base-emitter voltage $\Delta V_{BE}$ between the two transistors. Such references generally produce an output of the form $V_{BE+\Delta V_{BE}}(A)$, where A is a gain factor. The $V_{BE}$ and $\Delta V_{BE}$ components have opposite polarity temperature coefficients ($\Delta V_{BE}$ is proportional to absolute temperature and $V_{BE}$ is complementary to absolute temperature) which tend to cancel one another out. Numerous variations in bandgap reference circuitry have been designed and are discussed, for example, in Fink et al. Ed., *Electronics Engineers' Handbook*, 3d ed., McGraw-Hill Book Co., 1989, pages 8.48–8.50.

Although the output of a bandgap voltage cell is ideally independent of temperature, the outputs of bandgap cells have been found to include nonlinear temperature dependencies which are difficult to compensate. Additionally, the initial temperature dependency of the $\Delta V_{BE}$ component is quite high, approximately 3000 ppm/°C., and the difficulty of compensating for a temperature coefficient is generally proportional to the magnitude of the initial temperature coefficient. Furthermore, a bandgap circuit's basic reference voltage $\Delta V_{BE}$ is developed across a fixed resistor and, because of process variations and other limits upon the accuracy with which an absolute resistance value (as opposed to a ratio of resistances) may be produced, the resistor imparts errors to the voltage reference. Amplification of $\Delta V_{BE}$, represented by the gain A, introduces further noise into the reference output. The use of an absolute resistance further degrades the bandgap reference's performance because the resistor value will drift over time, causing the reference's output to similarly drift. Yet another problem of bandgap references is a "hysteresis effect"; that is, a bandgap reference which produces an initial reference voltage will, after being heated and then returned to its initial temperature, produce a slightly different reference voltage.

SUMMARY OF THE INVENTION

The invention seeks to provide a JFET circuit which may be employed to produce a low-noise voltage reference that is stable over time and temperature and is available in a wide range of voltages. It does this with a pair of junction field effect transistors (JFETS) that are formed with a precisely controlled difference between their pinchoff voltages. The two JFETs are operated with the same ratio of drain current to size (i.e. channel width-to-length ratio, ID1/W1/L1=ID2/W2/L2). Additionally, the JFETs are operated in saturation and, by maintaining the equality of this ratio, the difference in the JFETs' gate-to-source voltages will equal the difference in pinch-off voltage between them ($\Delta V_{GS}=\Delta V_P$).

In a preferred implementation, equal size JFETS (i.e. having equal channel width-to-length ratios) are supplied with equal drain currents and their sources are connected to a common voltage. The resulting difference in gate-to-source voltage between them provides a reference voltage. This basic circuit may be produced using p-channel or n-channel and enhancement-mode or depletion mode JFETs to provide positive or negative voltage references. The temperature coefficient of the reference is linear and, in one implementation, a current source which is proportional to temperature is employed to compensate for the basic reference's temperature-dependent drift.

The initial temperature coefficient of the basic two-JFET circuit is relatively low, approximately 100 ppm/°C., and linear. Temperature coefficient compensation is therefore relatively easy and effective. The noise figure for the basic circuit is approximately 100 nV/√Hz when operated at a bias current of 6 $\mu$A. This makes it particularly suitable for low-noise, low-power applications (the noise figure may be improved by operating the circuit at a higher bias current). The circuit does not depend upon absolute resistance values, as with bandgap references, and therefore avoids the introduction of errors due to initial and time-dependent inaccuracies in resistor values. The circuit does not exhibit so severe a hysteresis effect as band-gap references and, unlike Zener references, it may be used for low-voltage applications, e.g., with a supply voltage of 5V or less.

The invention also includes a method for producing the JFETs with precisely controlled differences between their pinch-off voltages to make the reference highly accurate. The JFETs are substantially identical except for heavier ion implantation which alters the pinchoff voltages for some of the JFETs relative to those that do not receive the heavier implant.

These and other features, aspects and advantages of the invention will be apparent to those skilled in the art from the following detailed description, taken together with the accompanying drawings.

DETAILED DESCRIPTION OF THE INVENTION

The new JFET circuit and fabrication method are based upon JFET characteristics which can best be explained in the context of JFET device physics, a brief discussion of which is given below in connection with FIG. 2. A more detailed description may be found in Edward S. Yang, *Fundamentals of Semiconductor Devices*, McGraw-Hill Book Company, New York 1978, pages 182–195.

Figure 1:
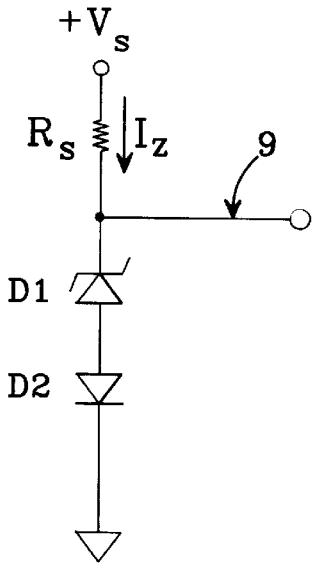
FIG. 1 (Prior Art)
FIG. 1 is a schematic diagram of a prior art Zener voltage reference circuit.
Figure 2:
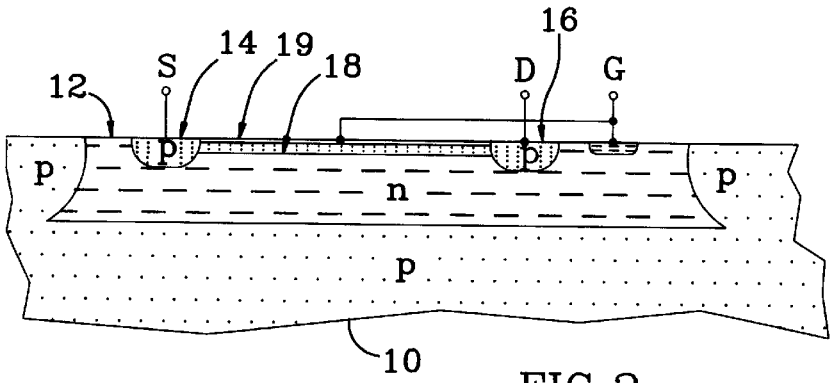
FIG. 2 (Prior Art)
FIG. 2 is a sectional view of a conventional p-channel JFET.

FIG. 2 is a sectional view of a conventional depletion mode p-channel JFET, which is preferable to an enhancement mode device because of biasing considerations. Further discussion of JFETs will therefore refer to depletion mode devices, but the novel circuit could also employ enhancement mode devices. The JFET of FIG. 2 is an ion-implanted device having a p-type substrate 10 with an n-type epitaxial tub 12 formed within the substrate 10. The n-type tub 12 has p-type source 14 and drain 16 regions diffused within it and a p-type channel 18 between the source 14 and drain 16 regions. An n-type top gate 19 is implanted over the p-type channel 18. In operation, the gate 19/channel 18 junction is reverse-biased.

In a depletion-mode JFET maximum drain current is produced when the gate 19 is shorted to the source 14. By increasing the gate/channel reverse bias, i.e. increasing the gate-to-source voltage, depletion regions will extend into the channel 18 such that drain current is substantially "pinched-off" for all values of drain-to-source voltage. The gate-to-source voltage at which this pinchoff occurs is referred to as the JFET's pinchoff voltage. Specifically, the pinchoff voltage of a JFET is given by:

$$V_P = a^2[qN_A(1+N_A/N_D)/2\in]-\Psi_0$$

where:

a=½ channel thickness q=electron charge

NA=effective channel doping $N_D$=effective gate doping $\in$=dielectric constant of the semiconductor material $\Psi_0$=built in junction voltage For purposes of illustration, the assumption will be made that the JFET is made of silicon and all device parameters will refer to silicon, e.g. $\in$ is the dielectric constant of silicon and has the value of 1.04 $E^{-12}$. The built in junction voltage $\Psi_0$ is very temperature dependent and highly non-linear: undesirable characteristics for a voltage reference. This undesirable temperature dependency arises from the built in junction voltage's relation to the JFET intrinsic carrier density:

$$\Psi_0 = kT/q \ln (N_A N_D/n_i^2)$$

Where:

k=Boltzmann's constant

T=temperature in K $n_i$=the intrinsic carrier density of silicon

Because the intrinsic carrier density $n_i$ doubles approximately every 8K and is highly non-linear, the built-in junction voltage is also highly temperature dependent and non-linear. However, in the new reference circuit, the reference voltage is a function of the difference in pinchoff voltage between two JFETs. That is, $$V_{REF} = \Delta V_P = \{a^2[qN_A(1+N_A/N_D)/2\in]-\Psi_0\}_1 - \{a^2[qN_A(1+N_A/N_D)/2\in]-\Psi_0\}_2$$

Using the difference between pinchoff voltages of two otherwise identical JFETs which have different channel doping densities eliminates the extreme nonlinear temperature dependency of the last term, $\Psi_0$. This is illustrated by the following equation:

$$\begin{aligned}\Delta\psi_0 &= kT/q \ln(N_{A1}N_D/n_i^2) - kT/q \ln(N_{A2}N_D/n_i^2)\\ &= kT/q \ln N_{A1}/N_{A2}\end{aligned}$$

where:

$N_{A1}$=is the higher effective channel doping of a first JFET $N_{A2}$=is the lower effective channel doping of a second JFET The intrinsic carrier density $n_i$ can therefore be eliminated from the expression for the reference voltage by substituting this expression for $\Delta\Psi_0$ into that for $\Delta V_P$:

$$V_{REF} = \Delta V_P = \{qa^2/2\in[N_{A1}(1+N_{A1}/N_D) - N_{A2}(1+N_{A2}/N_D)] - kT/q\,[ln(N_{A1}/N_{A2})]\}$$

To produce JFETs having the desired channel doping relationship, the difference between $N_{A1}$ and $N_{A2}$ must be precisely controlled. A diffusion process does not provide sufficient control of doping levels to produce the necessary precision in channel doping differences. An ion implantation process provides greater control over channel doping levels than a diffusion process, but this precision is conventionally employed to produce JFETs with precisely matched characteristics, not differences. Nevertheless, a single step ion-implantation process may be employed to provide the relative channel doping levels set forth above. However, employing a single channel-implantation step to produce precisely-controlled differences in channel doping levels (and therefore in pinchoff voltages) presents daunting control problems. Suppose, for example, that channel doping levels of 1.10 $E^{12}$ and 1.25 $E^{12}$ are desired to produce a difference in pinchoff voltages corresponding to a difference in doping levels of 0.15 $E^{12}$. If the implant process provides 10% accuracy, a single implant step could produce one JFET with 1.10±0.11 $E^{12}$ and another with 1.25±0.125 $E^{12}$. Consequently, the differences in channel doping levels could range from −0.085 to 0.385 $E^{12}$, clearly an unacceptable result.

For this reason, a new two-step channel ion implantation process is employed in a preferred method to produce the desired difference in pinchoff voltages. That is, the desired difference in channel doping is produced by first producing JFETs using a conventional ion implantation process, i.e. one which yields substantially identical channel doping levels. Then a novel second channel implantation is performed on selected JFETs to produce the desired difference in pinchoff voltages. Using the same target figures as in the above example, i.e., doping levels of 1.1 $E^{12}$ and 1.25 $E^{12}$, and the same 10% variation in doping accuracy, the new method will produce a much lower variation between target and actual doping level differences. If, for example, the initial channel doping is too heavy by 10%, both JFET channels will have channel doping levels of 1.21 $E^{12}$. If, in the worst case, the second channel doping, targeted at 0.15 $E^{12}$, is also 10% too heavy, one of the JFET channels will be doped to a level of 1.21 $E^{12}$ and the other will be doped to a level of 1.375 $E^{12}$, yielding a channel doping level difference of 0.165 $E_{12}$, much closer to the target value of 0.15 $E^{12}$ than would reliably be provided by a single implantation step.

In one implementation a pair of p-channel JFETs are produced using Boron ions accelerated to 180 KeV and implanted and driven to a depth of approximately 0.95 $\mu$m, at a concentration, or "dose", of approximately 1.10 $E^{12}$ atoms/cc. Another 180 KeV Boron implant of 0.15 $E^{12}$ concentration is then performed on the JFET(s) which is to have the higher pinchoff voltage, yielding a final doping concentration within that JFET of approximately 1.25 $E^{12}$ atoms/cc. The top gates of all the JFETs are then implanted with 150 KeV Phosphorous driven to a depth of approximately 0.37 $\mu$m and concentration of 1.50 $E^{12}$ atoms/cc. This combination yields a pinchoff voltage difference between the JFETs of approximately 0.5V.

Figure 3:
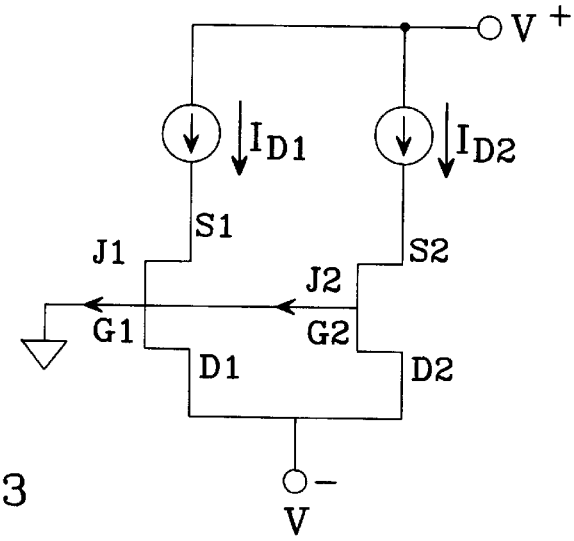
FIG. 3 is a schematic diagram of a pair of JFETs having different pinchoff voltages in accordance with the invention.

Using JFETs having controlled pinchoff voltage variations as described, a novel circuit, illustrated in FIG. 3, develops a low-noise output voltage having a linear temperature coefficient which may be used, as described in relation to FIGS. 4–7, as a voltage reference. In saturation, the drain current of a JFET is given (approximately) by the following relationship:

$$I_D = I_{dSS}(1 - V_{GS}/V_P)^2$$

which can be rearranged to yield:

$$V_{GS} = V_P - V_P(I_D/I_{DSS})^{1/2}$$

where:

$V_{GS}$=JFET gate-to-source voltage $I_D$=JFET drain current $I_{DSS}$=saturation drain current $V_P$=pinchoff voltage Given this relationship, the pinchoff voltage, an "internal" device characteristic, may be "brought outside", or reflected in an external circuit. The difference in pinchoff voltages between two JFETs may be converted, for $$\begin{aligned} V_{GS1} - V_{GS2} &= \{V_p - V_p(I_D/I_{DSS})^{1/2})_1 - \{V_p - V_p(I_D/I_{DSS})^{1/2})_2 \\ &= V_{p1} - V_{p2} - V_{p1}(I_{D1}/I_{DSS1})^{1/2} + V_{p2}(I_{D2}/I_{DSS2})^{1/2} \end{aligned}$$

Because the difference in pinchoff voltages is well controlled with the novel process discussed in relation to FIG. 2, the difference in gate-to-source voltage should, ideally, be dependent only upon the first two terms on the right of the equation, i.e., $V_{p1}-V_{p2}$. To eliminate the other terms on the right of the equation, one may note that a JFET's saturation drain current $I_{DSS}$ can be expressed as a function of the its channel width-to-length ratio and transconductance, as follows:

$$I_{DSS} = W/L\beta(V_P)^2$$

where:

W=channel width

L=channel length

β=transconductance parameter(approximately 7 $\mu A/V^2$ in a preferred implementation)

Substituting this expression for $I_{DSS}$ yields:

$$V_{P1}[(I_{D1}/((w_1/L_1)\beta(V_{p1})^2)]^{1/2} + V_{P2}[(I_{D2}/((w_2/L_2)\beta(V_{P2})^2)]^{1/2}$$

for the unwanted terms. These terms cancel one another when:

$$I_{D1}/(W_1/L_1) = I_{D2}/(W_2/L_2)$$

In a preferred embodiment, two JFETs are fabricated with equal channel width-to-length ratios and unequal pinchoff voltages. In operation, the JFETs are provided with equal drain currents.

Returning to FIG.3, J1 and J2 are p-channel depletion mode JFETs fabricated with equal channel width-to-length ratios. Their respective gates G1 and G2 are connected to a ground supply and their drains D1 and D2 are connected to a negative supply $V^-$. Current sources ID1 and ID2 force equal saturation currents from a positive supply $V^+$into J1 and J2, respectively. The pinchoff voltage of JFET J1 is higher than that of J2 and, because the JFETs are in saturation, the difference in their pinchoff voltages will be reflected at their source terminals S1 and S2, respectively. That is, the difference in pinchoff voltages equals the difference in gate-to-source voltages. Because their gate voltages are equal, the source terminal of JFET J2 will therefore be $\Delta V_P$ higher than that of J1.

Figure 4:
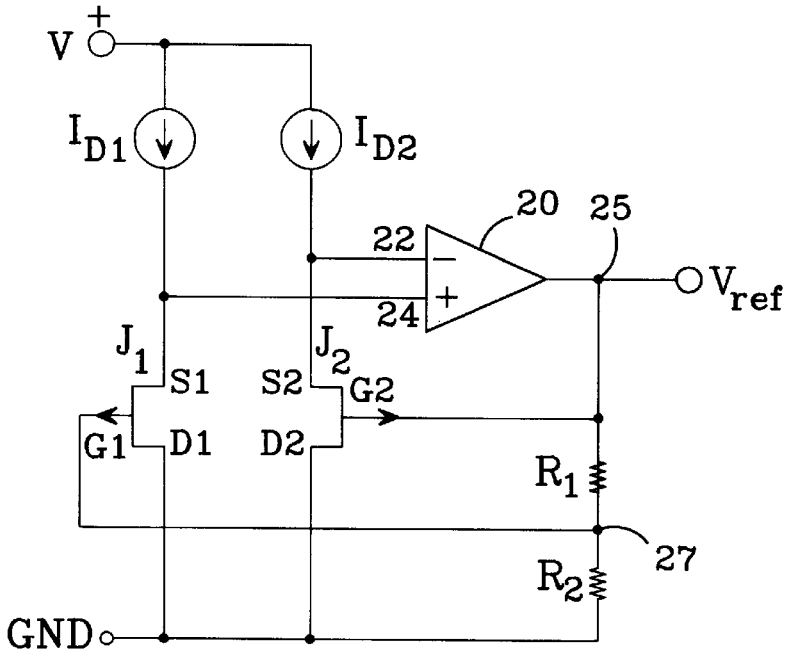
FIG. 4 is a schematic diagram of a positive voltage reference based upon the circuit of FIG. 3.

A positive voltage reference circuit which employs the novel JFET pair is illustrated by the schematic diagram of FIG.4. A pair of p-channel JFETs J1 and J2 have their respective drains D1 and D2 connected to ground GND. Their sources S1 and S2 are connected to the noninverting 24 and inverting 22 inputs respectively of an op amp 20 and to current sources ID1 and ID2 which provide equal drain-source currents to the JFETs. Since the op amp inputs 22 and 24 will be at substantially the same voltage, current sources ID1 and ID2 may be implemented as equal resistors connecting the inputs 22 and 24 to the positive supply $V^+$. The pinchoff voltage of J2 is greater than that of J1. The output 25 of the op amp 20 is connected through a series combination of resistors R1 and R2 to a return supply GND. In a preferred implementation, resistors R1 and R2 are low temperature coefficient of resistance thin film resistors. The gate G2 of J2 is connected to the op amp output 25 and to the "high" side of resistor R1. The gate G1 of JFET J1 is connected to the junction 27 of resistors R1 and R2, i.e., the resistor R1 is connected across the gates of JFETs J1 and J2.

The JFETs J1 and J2 have been fabricated in the manner set forth above, i.e. an extra implantation produces a higher pinchoff voltage for J2 than that of J1 and the width-to-length ratios of J1 and J2 are equal. Consequently, with equal drain currents forced through them, their gate-to-source voltages differ by the difference between their pinchoff voltages and this voltage is impressed across resistor R1. The current through R1 and R2 is $\Delta V_P/R1$ and the total voltage across R1 and R2, appearing at the output 25 of the op amp 20, will be $\Delta V_P(1+R2/R1)$. For proper circuit operation, as noted above, the JFETs J1 and J2 must be operated in saturation, therefore the output reference voltage $V_{REF}$ is greater than the greater of the two JFET pinchoff voltages. Substituting n-channel JFETs for the p-channel J1 and J2 illustrated and reversing the current sources, the circuit of FIG. 4 yields a negative voltage reference with an output voltage of $-\Delta V_P(1+R2/R1)$.

Figure 5:
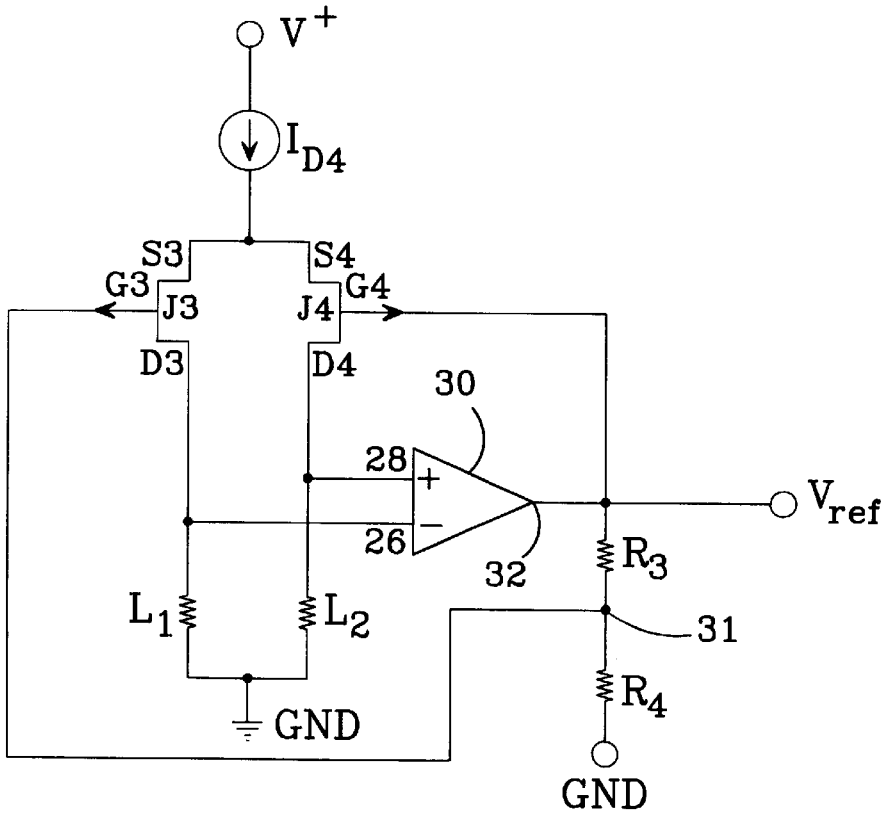
FIG. 5 is a schematic diagram of another positive voltage reference circuit based upon the circuit of FIG. 3.

The novel JFET pair is also employed in the positive voltage reference of FIG. 5. P-channel JFETs J3 and J4 are connected from their respective drains D3 and D4 through loads L1 and L2 (which could be active loads) to a return supply GND. The JFET drains D3 and D4 are also connected, respectively to the inverting 26 and noninverting 28 inputs of an op amp 30. The JFET sources S3 and S4 are connected to a current source ID4 and the pinchoff voltage of JFET J4 is higher than that of JFET J3. The op amp output 32 provides the circuit's reference voltage output and is connected through a series combination of resistors R3 and R4 to the return supply GND and to the gate of J4. The junction 31 of series resistors R3 and R4 is connected to the gate of J3. With the loads L1 and L2 equal, the op amp 30 forces the gate-to-source voltages of J3 and J4 to a level which splits the current from the current source ID4 equally between J3 and J4, thereby maintaining substantially equal input voltages at the inverting 26 and noninverting 28 inputs of the op amp 30. With equal drain currents and equal source voltages, the difference between VGS4 and VGS3 ($\Delta V_P$) is impressed across resistor R3 and the current through resistors R3 and R4 is $\Delta V_P/R3$. The circuit's output reference voltage $V_{REF}$ therefore is $\Delta V_P(1+R4/R3)$. Because this circuit requires more "headroom" to keep the JFETs in saturation, the reference output voltage $V_{REF}$ is restricted to values greater than the sum of the load voltage and the pinchoff voltage of JFET J4. Substituting n-channel JFETs for the p-channel J3 and J4 illustrated and reversing the current source, the circuit of FIG. 5 yields a negative voltage reference with an output voltage of $-\Delta V_P(1+R4/R3)$.

Figure 6:
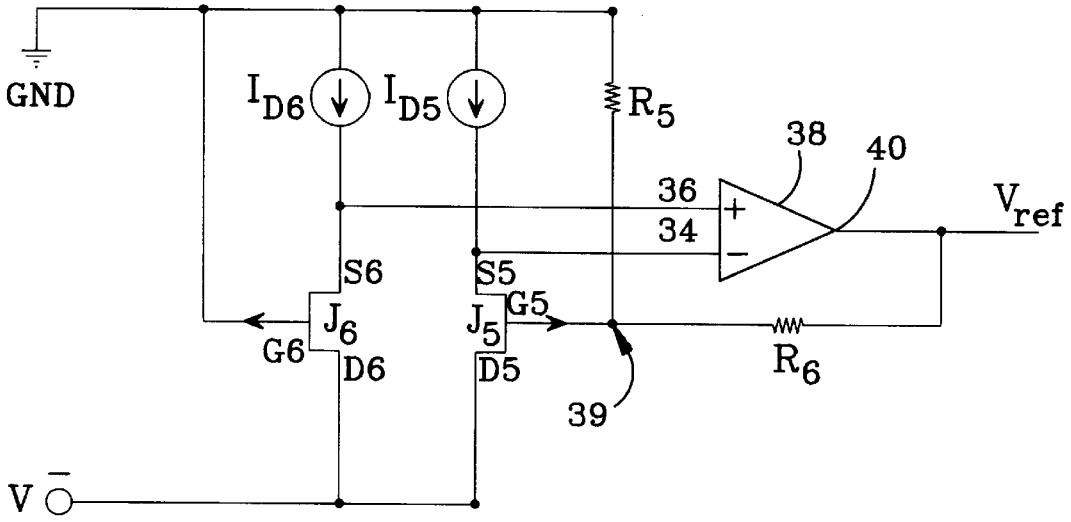
FIGS. 6 and 7 are schematic diagrams of alternate negative voltage reference circuits in accordance with the invention.

A negative voltage reference, employing novel p-channel JFETS, is illustrated in the schematic diagram of FIG. 6. The drains D5 and D6 of JFETs J5 and J6 are connected to a negative supply $V^-$and their sources S5 and S6 are respectively connected to the inverting 34 and noninverting 36 inputs of an op amp 38. Current sources ID5 and ID6 provide equal drain-source currents for the JFETs J5 and J6, and maintain them in saturation. The pinchoff voltage of JFET J6 is greater than that of J5. Resistors R5 and R6 are connected in series between ground GND and the op amp output 40. The junction 39 of series resistors R5 and R6 is connected to the gate of J5. Consequently, the JFETs' $\Delta V_P$ is impressed across R5 and the current through R5 and R6 is $\Delta V_P/R5$. The output reference voltage $V_{REF}$ for this circuit is, then, $-\Delta V_P(1+R6/R5)$. To maintain the JFETs J5 and J6 in saturation, the magnitude of the output reference voltage must exceed the pinchoff voltage of J6. A positive reference could also be produced using the same circuit by reversing the current sources and substituting n-channel JFETs for the p-channel JFETs J5 and J6.

Figure 7:
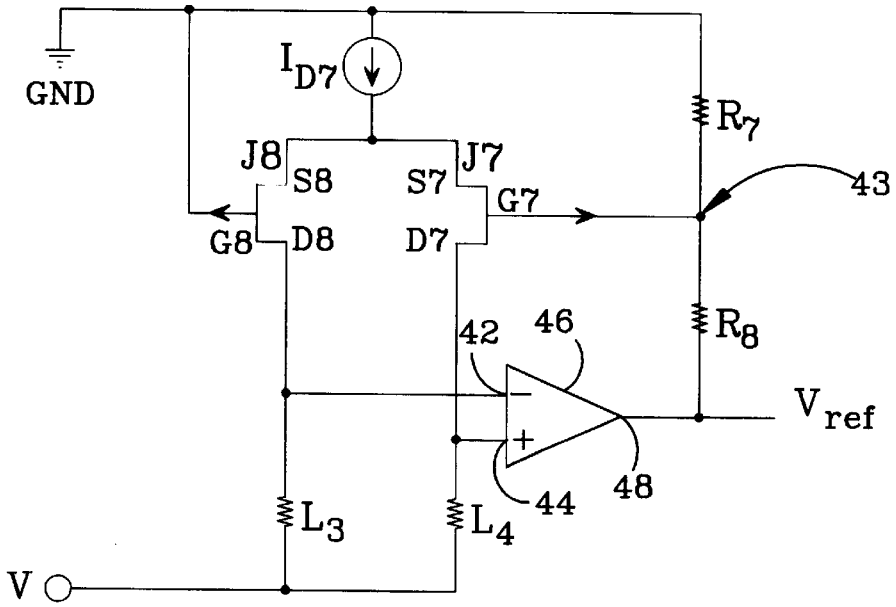

The circuit of FIG. 7 produces a lower-noise negative voltage reference $V_{REF}$, using new p-channel JFETs. The pinchoff voltage of JFET J8 is higher than that of JFET J7 and the sources S7 and S8 of JFETs J7 and J8 are connected through a current source ID7 to a ground supply GND. The drains D8 and D7 of J8 and J7 are connected respectively through equal loads L3 and L4 (L3 and L4 could be active loads) to a negative supply $V^-$, and directly to the inverting 42 and noninverting 44 inputs of an op amp 46. A voltage divider composed of resistors R7 and R8 connected in series spans the op amp output 48 and the ground supply GND. The junction 43 of the resistors R7 and R8 is connected to the gate of JFET J7. The op amp 46 establishes a voltage at its output 48 such that the gate-to-source voltage of J7 steers equal currents through J7 and J8, thus maintaining equal voltages at its inputs 42 and 44. Since the op amp 46 maintains equal drain currents through J7 and J2, the difference between their pinchoff voltages will appear across R7 and the current through R7 and R8 will equal $-\Delta V_P/R7$. The output reference voltage therefore equals $-\Delta V_P(1+R8/R7)$. A positive reference may also be produced by substituting n-channel JFETs for the p-channel devices and reversing the current sources.

Figure 8:
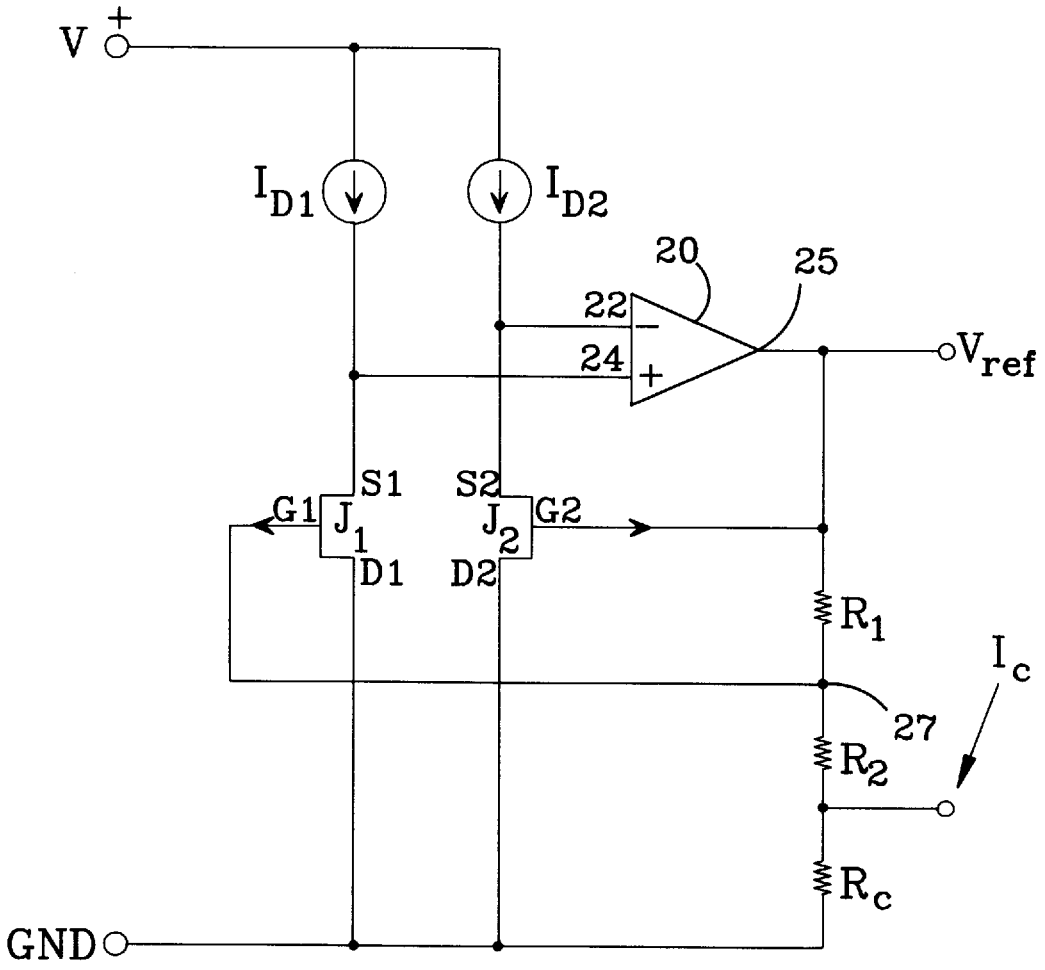
FIG. 8 is a schematic diagram of the positive voltage reference circuit shown in FIG. 4 with an added temperature compensation.

The circuits of FIGS. 4–7 yield voltage references having temperature coefficients of approximately −120 ppm/°C. This figure is orders of magnitude less than for an uncompensated Vbe used in bandgap references, and several times lower than the figure for a Zener reference, but it is still too high for many applications. Because this temperature coefficient is linear and relatively small, it may be readily compensated by introducing a temperature compensation current Ic, as illustrated in FIG. 8 (an implementation based upon the circuit of FIG. 4). All components of FIG. 8 are identical to those of FIG. 4, with the exception that a compensation resistor Rc has been added between resistor R2 and ground. The compensation current has a positive temperature coefficient of 120 ppm /°C. and may be developed from a ΔVbe source, for example. The compensation current Ic develops a positive temperature coefficient voltage across the compensation resistor Rc which cancels the negative temperature coefficient of the basic reference circuit. The compensation resistor Rc may optionally be eliminated, with the compensation current injected at the junction of resistors R1 and R2. The compensation circuit should be biased so that Ic does not alter the reference voltage output $V_{REF}$.

The forgoing description of specific embodiments of the invention has been presented for the purposes of illustration and description. It is not intended to be exhaustive or to limit the invention to the precise forms disclosed, and many modifications and variations are possible in light of the above teachings. For example, enhancement mode JFETs may be used, with proper biasing, to effect the circuits disclosed above. JFETs having differing channel width-to-length ratios may be employed, with corresponding differences in drain currents (as long as the ratio $I_{D1}/(W_1/L_1)=I_{D2}/(W_2/L_2)$ is maintained), within the reference circuits described. Parameters other than the drain currents may be forced, e.g. gate-to-source voltages may be forced to be equal, with a resultant difference in drain currents used as a reflection of the difference in pinchoff voltage between the JFETs. The novel JFET circuit pair having a difference in pinchoff voltage and operated with $I_{D1}/(W_1/L_1)=I_{D2}/(W_2/L_2)$ may be used in applications other than voltage references. The embodiments were chosen and described in order to best explain the principles of the invention and its practical application, to thereby enable others skilled in the art to best utilize the invention. It is intended that the scope of the invention be limited only by the claims appended hereto.

We claim:

1. A JFET voltage reference which provides a positive output voltage, comprising:

a pair of JFETs having source, drain and gate terminals, different channel doping densities which result in unequal pinchoff voltages, and equal channel width-to-length ratios, each JFET characterized by a source-drain current path between its respective source and drain terminals, an operational amplifier having inverting and noninverting inputs and an output, and a pair of equal current current sources, the source-drain current paths of said JFETs connected to opposite respective ones of said operational amplifier inputs and also to receive equal currents from said current sources and to establish respective current flow paths between said current sources and a ground reference through respective ones of said JFET source-drain current paths, said current source currents being sufficient to maintain said JFETs in saturation, and the gates of said JFETs connected across a resistor, said resistor being part of a resistance circuit that is connected to the operational amplifier output to reproduce the difference in pinchoff voltages between said JFETs across said resistor and to establish a voltage reference output as a function of the voltage across said resistor.

2. The voltage reference of claim 1, wherein said resistance circuit establishes said voltage reference output at said operational amplifier output.

3. The voltage reference of claim 1, wherein said JFETs are n-channel JFETs.

4. The voltage reference of claim 1, wherein said JFETs are p-channel JFETs.

5. The voltage reference of claim 1, wherein said JFETs have substantially equal gate doping levels.

6. A JFET voltage reference which provides a negative output, comprising:

a pair of JFETs having source, drain and gate terminals, different channel doping densities which result in unequal pinchoff voltages, and equal channel width-to-length ratios, each JFET characterized by a source-drain current path between its respective source and drain terminals, an operational amplifier having inverting and noninverting inputs and an output, and a pair of equal current current sources, the source-drain current paths of said JFETs connected to opposite respective ones of said operational amplifier inputs and also to receive equal currents from said current sources and to establish respective current flow paths between said current sources and a negative voltage supply through respective ones of said JFET source-drain current paths, said current source currents being sufficient to maintain said JFETs in saturation, and the gates of said JFETs connected across a resistor, said resistor being part of a resistance circuit that is connected to the operational amplifier output to reproduce the difference in pinchoff voltages between said JFETs across said resistor and to establish a voltage reference output as a function of the voltage across said resistor.

7. The voltage reference of claim 6, wherein said resistance circuit establishes said voltage reference output at said operational amplifier output.

8. The voltage reference of claim 6, wherein said JFETs are n-channel JFETs.

9. The voltage reference of claim 6, wherein said JFETs are p-channel JFETs.

10. The voltage reference of claim 6, wherein said JFETs have substantially equal gate doping levels.

* * * * *